United States Patent [19]

Joel, III

[11] 4,285,521

[45] Aug. 25, 1981

[54] SIMULATED ATHLETIC GAME

[76] Inventor: Lewin G. Joel, III, Box 184, Cohasset, Mass. 02025

[21] Appl. No.: 903,607

[22] Filed: May 8, 1978

[51] Int. Cl.[3] ..... A63F 3/00

[52] U.S. Cl. ..... 273/247; 273/298

[58] Field of Search ..... 273/94 R, 247, 93 C, 273/298

[56] References Cited

U.S. PATENT DOCUMENTS

| | | | |
|---|---|---|---|
| 1,138,678 | 5/1915 | McNair | 273/94 R |
| 1,331,196 | 2/1920 | Hart | 273/94 R |
| 2,060,973 | 1/1935 | Brown | 273/247 |
| 3,730,528 | 5/1973 | Corrado | 273/247 |

OTHER PUBLICATIONS

*Football Strategy* as described in the *Avalon Hill Catalog of Games* by the Avalon Hill Game Company, Fall--Christmas 1979.

*Primary Examiner*—Richard C. Pinkham
*Assistant Examiner*—Carl Moy

[57] ABSTRACT

A card deck is adapted to simulate strategic play of a competitive athletic game of the type having opposing offensive and defensive sides. The offense and defense players, respectively, are provided with different segments of the card deck. The offense and defense card sets each include indicia arranged so that when a particular offense card is matched with a particular defense card, the outcome of a selected offense play may be determined. In this matter the players may select and match cards to simulate the play of an athletic game. The indicia on the cards are arranged as to enable the players to simulate the strategy of an actual athletic game.

2 Claims, 7 Drawing Figures

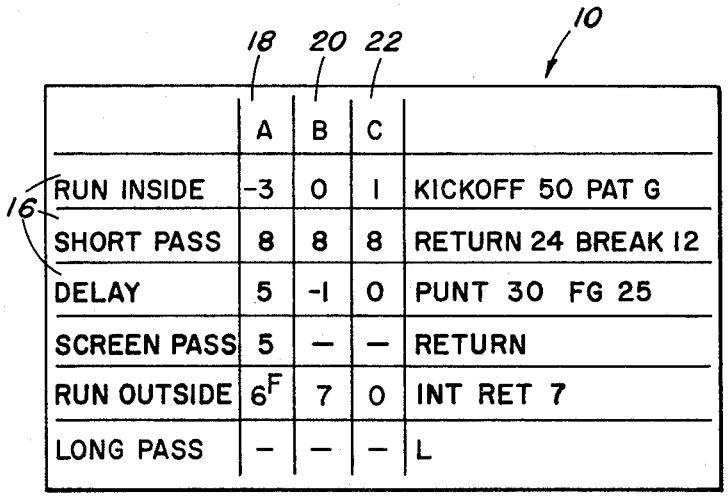

| | A | B | C | |
|---|---|---|---|---|
| RUN INSIDE | -3 | 0 | 1 | KICKOFF 50 PAT G |
| SHORT PASS | 8 | 8 | 8 | RETURN 24 BREAK 12 |
| DELAY | 5 | -1 | 0 | PUNT 30 FG 25 |
| SCREEN PASS | 5 | — | — | RETURN |
| RUN OUTSIDE | $6^F$ | 7 | 0 | INT RET 7 |
| LONG PASS | — | — | — | L |

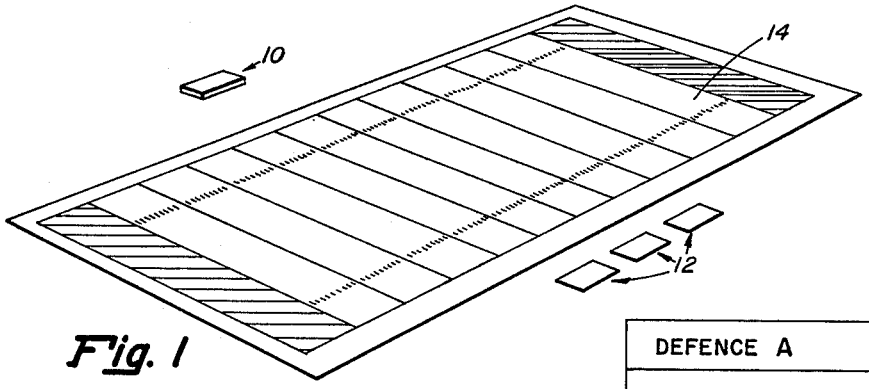

Fig. 1

10

| | A (18) | B (20) | C (22) | |
|---|---|---|---|---|
| RUN INSIDE | -3 | 0 | 1 | KICKOFF 50 PAT G |
| SHORT PASS | 8 | 8 | 8 | RETURN 24 BREAK 12 |
| DELAY | 5 | -1 | 0 | PUNT 30 FG 25 |
| SCREEN PASS | 5 | — | — | RETURN |
| RUN OUTSIDE | $6^F$ | 7 | 0 | INT RET 7 |
| LONG PASS | — | — | — | L |

16

Fig. 2a

| | A | B | C | |
|---|---|---|---|---|
| RUN INSIDE | 0 | 0 | 0 | KICKOFF 63 PAT G |
| SHORT PASS | — | — | 10 | RETURN 12 BREAK 33 |
| DELAY | $9^B$ | $7^B$ | $8^B$ | PUNT BL FG 15 |
| SCREEN PASS | $13^B$ | $10^B$ | $10^B$ | RETURN |
| RUN OUTSIDE | 1 | 2 | 0 | INT RET 31 |
| LONG PASS | $23^B$ | $73^B$ | $10^B$ | R |

24 26

16

Fig. 2b

10

| | A (18) | B (20) | C (22) | |
|---|---|---|---|---|
| RUN INSIDE | 1 | 1 | 4 | KICKOFF 54 PAT G |
| SHORT PASS | 1 | 3 | 6 | RETURN 26 BREAK 44 |
| DELAY | 3 | 0 | 1 | PUNT 44 FG 30 |
| SCREEN PASS | 3 | — | — | RETURN |
| RUN OUTSIDE | 2 | 4 | -1 | INT RET 9 |
| LONG PASS | — | — | — | R |

16

Fig. 2c

12

DEFENCE A

| | |
|---|---|
| 1st | RUN INSIDE<br>SHORT PASS |
| 2nd | RUN OUTSIDE<br>LONG PASS |
| 3rd | DELAY<br>SCREEN |

Fig. 3a

12

DEFENCE B

| | |
|---|---|
| 1st | DELAY<br>SCREEN |
| 2nd | RUN INSIDE<br>SHORT PASS |
| 3rd | RUN OUTSIDE<br>LONG PASS |

Fig. 3b

12

DEFENCE C

| | |
|---|---|
| 1st | RUN OUTSIDE<br>LONG PASS |
| 2nd | DELAY<br>SCREEN |
| 3rd | RUN INSIDE<br>SHORT PASS |

Fig. 3c

SIMULATED ATHLETIC GAME

BACKGROUND OF THE INVENTION

This invention relates to games adapted to simulate play of a competitive athletic game and, particularly, to simulate the competitive strategy employed both by the offense and defense in such a game. Although many games have been proposed in the prior art for simulating athletic competition, these games, in general, employ boards on which the game must be played as well as other relatively bulky associated game apparatus necessary for play. Additionally, most of the prior games do not afford an opportunity for the players to make effective use of offensive and defensive strategies normally found in actual competition. In those games where the players may employ some strategy, the degree or freedom of available strategy is limited. It is among the primary objects of the invention to provide a game apparatus in the form of specially arranged compact cards which simulates the strategic play of competitive athletic games and which enables the players to employ a high degree of strategy in such play.

The patent to Lindquist, U.S. Pat. No. 2,044,506, issued June 16, 1936, discloses a game board, with an offensive strip which is slidably engaged, the strip having indicia denoting a plurality of offensive plays. Play outcome is achieved by the roll of dice and reading results on the game board. In this case, there is no conscious selection of a defense.

The patent to Westbrook, U.S. Pat. No. 2,743,105, issued Apr. 24, 1956, discloses the use of a number of defensive play cards, one of which is selected by the defensive player and kept concealed until after the selection of the offensive player when it is then revealed. The offensive player selects his play and rolls a pair of dice. Results are determined by the dice roll and schedules which vary in results depending on whether the defensive player correctly predicted the offensive play.

The patent to Alderman, et al, U.S. Pat. No. 2,305,463, issued Dec. 15, 1942, utilizes a mechanical device to select a number which is determined by play selection of the offensive player and selection of a defense by the defensive player. The resulting number is then found on a chart to determine the ultimate results. There is no indication that the chart may be easily changed to another chart.

None of the mentioned prior art patents disclose a game which is compact enough to be carried around on the person. Furthermore, in contrast to the above cited patents, the inventor's game incorporates the chance-determinative element into cards avoiding the need for any supplemental external chance-determinative means such as dice, spinning wheels or the like.

SUMMARY OF THE INVENTION

In brief, the invention includes a deck of cards separable into two sets, one set containing a large number of cards, for use by the player on offense and another set of considerably fewer cards which are employed by the player on defense. The cards in the offense set include indicia indicating a number of possible plays from which the player on offense may select. Each offense card also includes indicia, associated with the indicia indicating the selectable plays, for indicating a number of possible outcomes for each of such selectable plays. The particular outcome of any play selected by the player on offense is dependent on which of the defense cards the defense player has selected. The defense set of cards are equal in number to the number of possible outcomes for the selectable offense plays. Each defense includes indicia which correlates with one of the possible outcomes of the particular selected offense play. In play, the defense player determines his defense unknown to the offense player, by selecting one of the defensive cards. The offense player then declares which play he has selected and then exposes the uppermost offense card in his stack. The exposed offense card and the selected defense card then are compared to match the indicia thereon and to determine the outcome of the selected offensive play.

It is among the primary objects of the invention to provide an improved game in the form of a deck of cards which is adapted to simulate strategic play of a competitive athletic game.

Another object of the invention is to provide an improved game of the type described which is compact and which may be carried about one's person easily.

Another object of the invention is to provide a game adapted to simulate athletic competition in which the players have a wide latitude in determining their respective strategies.

A further object of the invention is to provide a card game adapted to simulate athletic play which may be employed to teach the rules of play of the particular athletic game.

DESCRIPTION OF THE DRAWINGS

These and other objects and advantages of the invention will be understood more fully from the following detailed description thereof, with reference to the accompanying drawings wherein:

FIG. 1 is an illustration of a representative football game as set up for play;

FIGS. 2*a*, 2*b* and 2*c* illustrate representative offensive cards; and FIGS. 3*a*, 3*b* and 3*c* illustrate representative defense cards.

DESCRIPTION OF THE PREFERRED EMBODIMENT

FIG. 1 shows the deck of cards separated into its two sets, the set of offensive cards 10 and the set of defense cards 12. If desired, the game set also may include a foldable sheet 14 representing the playing field related to the particular athletic game with which the cards are concerned. For example, in the illustrative embodiment, the sheet 14 includes an imprinted miniaturized football field. The sheet 14 may be folded into the same size as the cards 10, 12 so that all the elements may be packed in a small compact box if desired. The cards 10, 12 may be the same size as conventional playing cards and the sheet may be foldable to that size so that the sheet 14 and cards 10,12 all may be packaged conveniently within the box. If desired, appropriate tokens, such as a football marker and a 10-yard "first down" marker also may be included in the game set and may be packed within the box.

Although the number of cards in the complete deck may be varied, the illustrative embodiment, which relates to a football game, preferably includes fifty offense cards 10 and a small number of defense cards 12. Each offense card 10 include identical backs so that when they are placed face down the cannot be distinguished from each other. All of the defense cards 12 in the defense set similarly include identical backs which are different, however, from the backs of the offensive cards 10.

Representative offense cards 10 are shown in FIGS. *2a, 2b* and *2c*. Each offense card includes a plurality of regions 16, arranged in vertical alignment, in which are imprinted a corresponding plurality of selectable offense plays such as "run inside", "short pass", etc. The selectable offense plays indicated in the regions 16 are of a character which occur with regular high frequency during actual play. The outcome of such plays is dependent on the defensive strategy employed. This category of plays are referred to herein as "defendable plays". The categories of defendable plays are arranged identically on each offense card and, in the illustrative embodiment, six such plays, characteristic of football, are arranged in columnar form. Adjacent the columns of selectable plays are a plurality of "outcome" columns 18, 20 and 22, which may be designated on the cards by the indicia A, B and C respectively. The intersection between any of the outcome columns and a selected defendable play includes indicia which indicates the outcome of the play. Thus, in the illustrative embodiment of the invention, for any given defendable offense play there are three possible outcomes. The particular outcome is determined by which one of the defense cards has been pre-selected by the defense player. For example, if the offense player has elected to attempt a "run inside" and the defense has pre-selected defense A, shown in FIG. *3a*, the outcome of that play would be a net loss of three yards. Had the defense player selected defense C (FIG. *3c*) the outcome of the play would have been a gain of one yard. Thus, the number of defense cards correspond to the number of outcome columns which, as shown, are three. The number of offense cards, however, is considerably greater and, in the football game illustrated, it is preferred to employ approximately fifty offense cards 10.

As shown in FIGS. *3a, 3b* and *3c*, the defense cards A, B, and C, respectively, preferably include indicia indicating the order of effectiveness of the particular defense, A, B or C, against the various defendable offense plays of the offense cards 10. Thus, defense card A general is most effective against a "run inside" or a "short pass", is less effective against a "run outside" and "long pass", and is least effective against a "delay" and a "screen". Similarly, defense card B includes means indicating the order of effectiveness of that defense against the selectable offense plays, as also is the case with defense card C. As can be seen, in the preferred embodiment of invention, each defense card 12 is most effective against different defendable offense plays than are the other defense cards in the defense card set. For example, defense card A is most effective against a "run inside" by the offense. Thus, of the fifty offense cards, the outcome indicated in outcome column A with respect to the "run inside" defendable offense play, a large proportion of these indicia show either a small or no yardage gain or, perhaps, a loss of yardage. Because during play of an actual football game, even a generally effective defense may give up yardage occasionally to a particular offense play a small proportion of the outcome indicia, even for the most effective defense should include substantial yardage gains. Thus, although defense A is generally most effective against a "short pass", the indicia in the outcome column A associated with the "short pass" on the offense card shown in FIG. 2A, indicates a gain of eight yards which is considered substantial for such a play. Most of the indicia, on the offense cards, however, relating to "short pass" in outcome column A would not have such a favorable yardage gain but preferably would show something less than eight yards or perhaps even a yardage loss.

During play, the offense player shuffles the stack of offense cards and then places the shuffled stack face down. The defense player then attempts to determine strategically what type of play the offense player would select at that time. The defense player then selects the defense card which represents the defense most effective against the type of play which he believes the offensive player will attempt. The defense player then places his selected defense card face down on the playing surface. After the defense player has committed his defense by selecting the defense card, the offense player then announces which of the defendable offense plays he shall attempt. The offense player then turns over the topmost of the offense cards in the face-down pack and that offense card is compared with the selected defense card of the defense player. The indicia, A, B or C on the selected defense card determines which of the outcome columns 18, 20 or 22 is referred to, to determine the outcome of the play. For example, if the defense player expected the offense to attempt a "long pass" or a "run outside" he would select defense card C shown in FIG. *3c*. If the offense player did select the "run outside" play and turned over the card shown in FIG. *2c*, the outcome of the play would be a net loss of one yard. If, however, the offense player had selected a "short pass", the C defense would have allowed a six yard gain for the offense, the C defense being relatively ineffective against the "short pass". The play would continue in this manner in accordance with conventional and well-known rules of football as played in the United States in which the offense is permitted series of four play attempts or "downs" in which to score a touchdown or gain ten yards which would give the offense a "first down" and enable the offense to repeat the four-down sequence.

The offense cards have been described thus far only with regard to plays of the "defendable" type as described above. As is well known by those familiar with football, there are a number of other types of plays which occur with somewhat less frequency than those shown in the defendable offense play region 16 of the offense cards. In these plays the outcome is generally subject to less variation than the defendable plays. Such plays are referred to herein as "undefended". For example, such undefended plays might include the "kickoff", "the point after touchdown" (PAT), "punt", kickoff or punt "return" or "field goal" (FG). Additionally, other plays occur relatively infrequently such as a "break" from a tackle or an intercepted pass return (INT RET). These types of "undefended" plays are accounted for by providing indicia corresponding to their outcome directly on the offense card itself. The particular outcomes of each of the undefended plays may be selected on the basis of probabilities and outcomes of varying magnitudes may be employed on the fifty offense cards for each of the particular undefended plays. Thus, each offense card includes a region indicating the outcome of the defendable plays, which outcome is determined with reference to the defense card selected by the defense player, and region including a number of undefendable plays having only one possible outcome for each offense card in which indicia corresponding to the outcome is provided directly on the offense card itself.

Various embellishments and modifications may be incorporated into the outcome indicia. For example, as shown in the offense card of FIG. 2*b*, some of the outcome indicia include, in addition to the number of yards gained or lost, the superscript "B". This is intended to indicate that the offense play initially resulted in a gain of, for example, ten yards, with the ball carrier then breaking away from the tackler. In order to determine the amount of yardage gained after the breakaway, the offense player then turns over the next offense card in the stack to determine the additional yardage gained as a result of the break. For example, if the next card in the stack were the card shown in FIG. 2*c*, the offense would have gained an additional forty-four yards after the "break". Because such breaks for relatively large yardage gains are infrequent in actual athletic competition they similarly should occur relatively infrequently throughout the set of offense cards. Similarly, some plays may result in fumbles by the offense team. This is taken into consideration by providing appropriate indicia, as the superscript F as shown in FIG. 2*a*. Thus, if a "run outside" were selected and the defense A had been preselected by the defense player, the ball carrier would be considered as having fumbled the ball after a six yard run. In order to determine the outcome of the fumble, the next succeeding card in the offense card stack is turned over to determine whether the ball was lost (L) or recovered (R) by the offense. Similarly, the outcome of a punt may be blocked as indicated by the indicia BL in FIG. 2*b*.

Each time the offense player loses the ball, either by having run four downs or plays, by a punt or otherwise, the players switch card stacks. Play continues in this manner until all fifty offense cards provides sufficient variation in the number of plays and outcomes thereof as to simulate the action and strategy of a real football game. Approximately fifty offense cards may be exposed in a fifteen minute time interval which corresponds to one quarter of a regular football game.

The particular quantitative outcomes of the particular plays may be arranged as desired but should be selected to represent realistic results. For example, the following approximately average yardage gains for various typical football plays are as follows:

| | | | |
|---|---|---|---|
| RUN INSIDE | 3¼ yds. | SCREEN PASS | 2½ yds. |
| SHORT PASS | 2½ yds. | RUN OUTSIDE | 4 yds. |
| DELAY | 3½ yds. | LONG PASS | 6¼ yds. |
| KICKOFF | 55 yds. | RETURNS | 23½ yds. |
| PUNT | 38 yds. | BREAK TACKLE | 15½ yds. |
| PASS INTERCEPTION RETURN | 8¾ yds. | | |

Short passes and screen passes may be considered as being completed in approximately 44% of the attempts and long passes completed in approximately 28% of the attempts. Points after touchdown attempts may be considered as "good" in approximately 86% of the attempts and fumbles lost in approximately 50% of occurrences.

It should be understood that the foregoing description of the invention is intended merely to be illustrative thereof and that other embodiments and modifications may be apparent to those skilled in the art without departing from its spirit. For example, although the invention has been described as employed in association with a football game, other athletic competitive games requiring strategic maneuvers on the part of the offense and defense may be developed in the manner described herein. The particular plays and their outcomes, of course, will depend on the nature of the particular athletic game which is represented.

Having thus described the invention, what I claim is:

1. A device for simulating strategic play of a competitive athletic game comprising:

a deck of cards including a first set of in play offense and a second set of in play defense cards, the number of in play offense cards being greater than the number of in play defense cards;

each of said offense cards in said first set having means indicating, on one face thereof, a plurality of defendable offense plays and means indicating a plurality of groups of outcomes for said defendable offense plays;

indicia means, on said one face of each of said offense cards, associated with each of said groups of said plurality of outcomes, each of said indicia means being distinguishable from the other of said indicia means on said offense card; and said defense cards being equal in number to the number of said indicia means, each of said defense cards bearing one of said indicia means whereby a particular outcome of a selected defendable offensive play may be determined with reference to matching indicia of an offense card with one of said defense cards, and means defining a region on each of said offense cards for indicating a plurality of different undefendable plays and a single outcome adjacent each of said undefendable plays.

2. A device for simulating strategic play of a competitive athletic game comprising:

a deck of cards including a first set of in play offense and a second set of in play defense cards, the number of in play offense cards being greater than the number of in play defense cards;

each of said offense cards in said first set having means indicating, on one face thereof, a plurality of defendable offense plays and means indicating a plurality of groups of outcomes for said defendable offense plays;

indicia means, on said one face of each of said offense cards, associated with each of said groups of said plurality of outcomes, each of said indicia means being distinguishable from the other of said indicia means on said offense card;

means on each of said defense cards for indicating the order of effectiveness of the defense represented by the indicia on said defense cards against the outcome of said defendable plays on said offense cards, means defining a region on each of said offense cards for indicating a plurality of different undefendable plays and a single outcome adjacent each of said undefendable plays, and said defense cards being equal in number to the number of said indicia means, each of said defense cards bearing one of said indicia means whereby a particular outcome of a selected defendable offensive play may be determined with reference to matching indicia of an offense card with one of said defense cards.

* * * * *